US011339492B2

(12) United States Patent
Wohlfarth et al.

(10) Patent No.: US 11,339,492 B2
(45) Date of Patent: May 24, 2022

(54) METHOD FOR ELECTRODEPOSITING ZINC AND ZINC ALLOY COATINGS FROM AN ALKALINE COATING BATH WITH REDUCED DEPLETION OF ORGANIC BATH ADDITIVES

(71) Applicant: Dr.-Ing. Max Schlötter GmbH & Co. KG, Geislingen/Steige (DE)

(72) Inventors: Volker Wohlfarth, Ulm (DE); Ralph Krauss, Böbingen (DE); Michael Zöllinger, Salach (DE)

(73) Assignee: Dr.-Ing. Max Schlötter GmbH & Co. KG, Geislingen/Steige (DE)

( * ) Notice: Subject to any disclaimer, the term of this patent is extended or adjusted under 35 U.S.C. 154(b) by 0 days.

(21) Appl. No.: 16/325,374

(22) PCT Filed: Feb. 5, 2018

(86) PCT No.: PCT/EP2018/052779
§ 371 (c)(1),
(2) Date: Feb. 13, 2019

(87) PCT Pub. No.: WO2018/146041
PCT Pub. Date: Aug. 16, 2018

(65) Prior Publication Data

US 2019/0376200 A1 Dec. 12, 2019

(30) Foreign Application Priority Data

Feb. 7, 2017 (EP) ..... 17155082

(51) Int. Cl.

| | |
|---|---|
| ***C25D 3/56*** | (2006.01) |
| ***C23C 4/11*** | (2016.01) |
| ***C23C 4/02*** | (2006.01) |
| ***C23C 4/08*** | (2016.01) |
| ***C23C 4/18*** | (2006.01) |
| ***C23C 28/00*** | (2006.01) |
| ***C25D 3/22*** | (2006.01) |
| ***C25D 17/10*** | (2006.01) |
| ***C25D 21/14*** | (2006.01) |
| ***C25D 21/18*** | (2006.01) |

(52) U.S. Cl.
CPC ..... *C25D 3/56* (2013.01); *C23C 4/02* (2013.01); *C23C 4/08* (2013.01); *C23C 4/11* (2016.01); *C23C 4/18* (2013.01); *C23C 28/3225* (2013.01); *C23C 28/345* (2013.01); *C25D 3/22* (2013.01); *C25D 17/10* (2013.01); *C25D 21/14* (2013.01); *C25D 21/18* (2013.01)

(58) Field of Classification Search
CPC ..... C25D 3/562; C25D 3/565
USPC ..... 205/246, 259
See application file for complete search history.

(56) References Cited

U.S. PATENT DOCUMENTS

| | | | | |
|---|---|---|---|---|
| 2,243,696 | A | 5/1941 | Ferm | |
| 4,814,048 | A | 3/1989 | Suzuki et al. | |
| 8,282,806 | B2 | 10/2012 | Fuhrmann | |
| 2002/0009638 | A1* | 1/2002 | Dattilo | H01M 4/04 429/215 |
| 2004/0031692 | A1 | 2/2004 | Hardee | |
| 2005/0133376 | A1* | 6/2005 | Opaskar | C25D 3/565 205/246 |
| 2007/0023280 | A1 | 2/2007 | Eckles et al. | |
| 2010/0116677 | A1* | 5/2010 | Fuhrmann | C25D 3/565 205/244 |
| 2011/0210006 | A1 | 9/2011 | Karagöl | |
| 2012/0160698 | A1 | 6/2012 | Brunner et al. | |

FOREIGN PATENT DOCUMENTS

| | | | | |
|---|---|---|---|---|
| CN | 102482417 | A | 5/2012 | |
| CN | 103227057 | A * | 7/2013 | H01G 11/86 |
| CN | 103911650 | A | 7/2014 | |
| CN | 105189831 | A | 12/2015 | |
| DE | 10306823 | A1 | 9/2004 | |
| DE | 10306823 | A1 * | 9/2004 | C25D 3/565 |
| DE | 10345594 | A1 | 5/2005 | |
| EP | 0090435 | A1 | 10/1983 | |
| EP | 1292724 | A1 | 3/2003 | |
| EP | 1344850 | A1 | 9/2003 | |
| EP | 1639155 | A1 | 3/2006 | |
| EP | 1702090 | B1 | 9/2007 | |
| EP | 1717353 | B1 | 4/2009 | |
| EP | 2184384 | A1 | 5/2010 | |
| EP | 2384800 | A1 | 11/2011 | |
| JP | S5091822 | A | 7/1975 | |
| JP | 2006-503187 | A | 1/2006 | |

(Continued)

OTHER PUBLICATIONS

Pecherskaya et al., "Influence of Impurities in the Electrodeposition of Zinc from Sulfate Solutions," Zhurnal. Prikladnoi. Khimii. (Sankt-Peterburg, Russian Federation) [1950], vol. 23, No. 9, pp. 920-935. (Year: 1950).*

(Continued)

*Primary Examiner* — Edna Wong
(74) *Attorney, Agent, or Firm* — Wolf, Greenfield & Sacks, P.C.

(57) ABSTRACT

The present invention relates to a method for the galvanic deposition of zinc and zinc alloy coatings from an alkaline coating bath with a reduced degradation of organic bath additives. An electrode that contains metallic manganese and/or manganese oxide and is insoluble in the bath is hereby used as an anode. The electrode is produced from metallic manganese or an alloy comprising at least 5% by weight of manganese, or from an electrically conductive substrate and a metallic manganese and/or manganese oxide-containing coating applied thereto, or from a composite material, wherein the coating and the composite material comprise at least 5% by weight of manganese. The method according to the invention is particularly suitable for the galvanic deposition of zinc-nickel alloy coatings from alkaline zinc-nickel baths since the formation of cyanides can be very effectively inhibited.

14 Claims, 2 Drawing Sheets

(56) References Cited

FOREIGN PATENT DOCUMENTS

| | | | | |
|---|---|---|---|---|
| KR | 2011-0090934 | A | 8/2011 | |
| RU | 2496887 | C1 | 10/2013 | |
| TW | I284684 | B | 8/2007 | |
| WO | WO-2004038071 | A2 * | 5/2004 | ..... C25D 17/10 |
| WO | WO 2004/108995 | A1 | 12/2004 | |
| WO | WO 2014/147180 | A1 | 9/2014 | |

OTHER PUBLICATIONS

Japanese Office Action for Application No. JP 2019-514818 dated Sep. 3, 2019.
[No Author Listed], Cuvette Test LCK 319: Cyanide. Hach Lange. 5 pages.
[No Author Listed], DIN 50 957. Deutsche Normen. 5 pages.
International Preliminary Report on Patentability for Application No. PCT/EP2018/052779 dated Jan. 4, 2019.
International Search Report and Written Opinion for Application No. PCT/EP2018/052779 dated Mar. 22, 2018.

* cited by examiner

METHOD FOR ELECTRODEPOSITING ZINC AND ZINC ALLOY COATINGS FROM AN ALKALINE COATING BATH WITH REDUCED DEPLETION OF ORGANIC BATH ADDITIVES

RELATED APPLICATIONS

This application is a national stage filing under 35 U.S.C. § 371 of International Patent Application No. PCT/EP2018/052779, filed Feb. 5, 2018, which claims the benefit of European Patent Application No. 17155082.5, filed Feb. 7, 2017, each of which is incorporated herein by reference in its entirety.

TECHNICAL FIELD

The present invention relates to a method for the galvanic deposition of zinc and zinc alloy coatings from an alkaline coating bath comprising zinc and zinc alloy electrolytes and organic bath additives such as complexing agents, brighteners and wetting agents. The invention furthermore relates to the use of materials as an anode for the galvanic deposition of a zinc and zinc alloy coating from an alkaline coating bath comprising zinc and zinc alloy electrolytes and organic bath additives as well as to a corresponding galvanic apparatus for depositing zinc and zinc alloy coatings.

BACKGROUND OF THE INVENTION

Alkaline zinc and zinc alloy baths are not typically operated with soluble zinc anodes. The zinc in soluble zinc anodes is electrochemically oxidised during anodic operation to form Zn(II). The formed Zn(II) ions thereby form the soluble zincate complex $Zn[(OH)_4]^{2-}$ with the surrounding hydroxide ions. In addition to electrochemical dissolution, zinc is oxidised to Zn(II) by the alkaline environment, thereby forming hydrogen. This means that the zinc anode is additionally chemically dissolved owing to the aforementioned redox reaction, which leads to an uncontrolled increase in the Zn(II) concentration in the zinc alloy electrolyte.

This leads on the one hand to a reduction in process reliability and on the other hand to the need to carry out further analyses in order to determine the additionally dissolved zinc content such that the concentration ratio in the zinc alloy electrolyte can be correctly adjusted.

Alkaline zinc and zinc alloy baths are therefore generally operated with insoluble anodes, and zinc is often dissolved in a separate zinc dissolving tank to form Zn(II) and added to the bath.

Materials which are electrically conductive and chemically inert, at least to bases, are thus used as the anode material. These are inter alia metals such as nickel, iron, stainless steel, cobalt or alloys of said metals. A further way to make use of, for example, the favourable properties of nickel as the anode material, but at the same time to save costs is to use galvanically nickel-plated steel anodes (bright nickel-plated steel anodes) with nickel coatings having a layer thickness of, for example, 30 μm. The main reaction occurring at the insoluble anode is the oxidative formation of oxygen.

When operating alkaline coating baths for the galvanic deposition of a zinc or zinc alloy coating, organic bath additives such as complexing agents, brighteners and wetting agents are normally also used in addition to the zinc or zinc alloy electrolyte.

It is inevitable in practice that oxygen generation does not just take place selectively on the surface of the insoluble anode. An undesirable anodic oxidation of the organic bath additives sometimes also occurs. This means that owing to this degradation, the concentration ratio of bath additive to zinc or zinc alloy electrolyte in the alkaline coating bath is no longer accurate, which is why more additives have to be added. The process costs are unavoidably driven up as a result.

Owing to the anodic oxidation of the organic bath additives, undesirable by-products, such as oxalates, carbonates, etc., can furthermore be formed, and these can have a disruptive effect on the galvanic coating process.

In particular in the case of alkaline zinc and zinc alloy baths where amine-containing complexing agents are used, an increased formation of cyanides can furthermore be observed owing to the undesirable anodic oxidation of the amine-containing additives.

Amine-containing complexing agents are, for example, used in coating baths for the galvanic deposition of a zinc-nickel alloy coating. The nickel is thereby used in the form of Ni(II), which, in the alkaline environment, forms a poorly soluble nickel-hydroxide complex with the surrounding hydroxide ions. In order to be able to dissolve the nickel in the form of Ni(II), alkaline zinc-nickel electrolytes therefore have to contain specific complexing agents with which Ni(II) would rather form a complex than with the hydroxide ions. Preferably used are amine compounds, such as triethanolamine, ethylenediamine, diethylenetetramine, or homologous compounds of ethylenediamine, such as diethylenetriamine, tetraethylenepentamine, etc.

When operating such coating baths for the deposition of a zinc-nickel alloy coating with amine-containing complexing agents, values of up to 1000 mg/l of cyanide can occur in the practice electrolyte until a balance between new formation and drag-out is achieved. The formation of cyanide is disadvantageous for many reasons.

When disposing of alkaline zinc and zinc alloy baths as well as the waste rinse water that occurs during operation, certain limits must be complied with and monitored. An often required limit for the concentration of cyanides in waste water is 1 mg/l. Owing to national or regional legislation, the permitted limits for cyanide concentrations in waste water may be even lower than this value. The formed cyanides must therefore be laboriously detoxified. This occurs in practice by means of oxidation, for example using sodium hypochlorite, hydrogen peroxide, sodium peroxydisulfate, potassium peroxymonosulfate or similar compounds. Furthermore, the dragged-out electrolyte also contains other oxidisable substances in addition to the cyanide, which is why considerably more oxidising agent is consumed for complete oxidation than can be theoretically determined based on the cyanide content.

Aside from the aspect mentioned above, an increased cyanide formation furthermore leads to the problem that undesired complexes can be formed with the bath additives.

When using a zinc-nickel electrolyte, the cyanide content is very disadvantageous from a technical point of view since nickel forms the stable tetracyanonickelate complex $Ni[(CN)_4)^{2-}$ with the formed cyanide ions, as a result of which the nickel bound in this complex is no longer available for deposition. Since it is not possible to make a distinction between the nickel forming a complex with cyanide and the nickel forming a complex with the amines during an ongoing electrolyte analysis, the increase in cyanide content in the electrolyte means a reduction in process reliability.

The deposition of zinc-nickel alloy coatings with a proportion of 10 to 16% by weight of nickel leads to very good corrosion protection on components made of ferrous materials and is therefore of great significance for technical corrosion protection. For the coating of components, in particular accessory parts for the automotive industry, highly alkaline electrolytes are used for the deposition of zinc-nickel alloy coatings so as to ensure a uniform layer thickness distribution even on the complex three-dimensional geometries of the components to be coated. In order to achieve a predetermined corrosion resistance, a minimum layer thickness must thereby be maintained on the component, which is normally 5 to 10 μm.

In order to be able to comply with the required alloy composition of 10 to 16% by weight of nickel over the entire current density range, the nickel concentration must be adjusted in accordance with the cyanide concentration in the electrolyte over the course of operation since the proportion of nickel that forms a complex with cyanide is not available for deposition. As the cyanide content in the electrolyte increases, the nickel content must therefore be adjusted accordingly in order to be able to keep the proportion of nickel in the layer constant. In order to maintain the required alloy composition, unplanned additions of nickel salts to the electrolyte must be carried out. Suitable replenishment solutions are nickel salts that have a high level of solubility in water. Preferably used for this purpose are nickel sulphate solutions in combination with various amine compounds.

The effects of a cyanide concentration of 350 mg/l in a conventional zinc-nickel alloy bath (zinc-nickel alloy bath SLOTOLOY ZN 80 of the firm Schlötter) are shown in the following examples in Table 1.

TABLE 1

| Electrolyte | Current density ($A/dm^2$) | Current yield (%) | Alloy composition (% by weight Ni) |
|---|---|---|---|
| New preparation | 2 | 50 | 14.3 |
| SLOTOLOY ZN 80 6.5 g/l Zn; 0.6 g/l Ni | 0.5 | 86 | 13.2 |
| New preparation | 2 | 73 | 8.1 |
| SLOTOLOY ZN 80 6.5 g/l Zn; 0.6 g/l Ni, 350 mg/l $CN^-$ (660 mg/l NaCN) | 0.5 | 83 | 8.9 |
| New preparation | 2 | 49 | 13.9 |
| SLOTOLOY ZN 80 6.5 g/l Zn; 0.6 g/l Ni, 350 mg/l $CN^-$ (660 mg/l NaCN) + 0.6 g/l Ni | 0.5 | 80 | 14.6 |

The above tests show that an intentional addition of 350 mg/l of cyanide to a newly prepared zinc-nickel alloy bath SLOTOLOY ZN 80 reduces the incorporation rate of nickel at a deposition current density of 2 $A/dm^2$ from 14.3% by weight to 8.1% by weight. In order to bring the alloy composition back into the specified range of 10 to 16% by weight, an addition of 0.6 g/l of nickel is necessary. This means doubling the nickel content in the electrolyte as compared to the new preparation.

The accumulation of cyanide in a zinc-nickel alloy electrolyte can also have a negative effect on the optical appearance of the deposition. In a high current density range, a milky/hazy deposition can occur. This can be corrected in part by a higher dose of brighteners. However, this measure is associated with an increased consumption of brighteners and thus additional costs during deposition.

If the cyanide concentration in a zinc-nickel electrolyte reaches values of approximately 1000 mg/l, it can furthermore become necessary to partially replace the electrolyte, which in turn drives up the process costs. In addition, large amounts of old electrolyte are accumulated during such partial bath replacements, which must be laboriously disposed of.

LITERATURE

There are a number of starting points in the prior art for solving the above-described problem:

EP 1 344 850 B1 claims a method in which the cathode region and the anode region are separated by an ion exchange membrane. This prevents the complexing agents from leaving the cathode region and reaching the anode. This prevents cyanide formation. A platinum-coated titanium anode is used as the anode. The anolyte is acidic and contains sulphuric acid, phosphoric acid, methanesulphonic acid, amidosulphonic acid and/or phosphonic acid.

A similar method is described in EP 1 292 724 B1. The cathode region and the anode region are also separated here by an ion exchange membrane. A sodium or potassium hydroxide solution is used as the anolyte. A metal or metal coating from the group consisting of nickel, cobalt, iron, chromium or alloys thereof is selected as the anode.

The formation of cyanides is reduced in both methods. The disadvantage of both methods is that very high investment costs are incurred owing to the incorporation of the ion exchange membranes. Furthermore, a device for the separate recycling of the anolyte must also be installed. In addition, the incorporation of ion exchange membranes is generally not possible in methods for zinc-nickel deposition. In order to increase productivity and to thus reduce the coating costs, auxiliary anodes are often used so as to optimise the layer thickness distribution if the racks are hung closely together. For technical reasons, it is not possible here to separate these auxiliary anodes by means of ion exchange membranes. Cyanide formation therefore cannot be completely prevented during such a use.

EP 1 702 090 B1 claims a method that separates the cathode region and the anode region by means of an open-pored material. The separator is composed of polytetrafluoroethylene or polyolefin, such as polypropylene or polyethylene. The pore diameters have a dimension of between 10 nm and 50 μm. In contrast to the use of ion exchange membranes, where charge transfer across the membrane occurs owing to the exchange of cations or anions, charge transfer can only occur in open-pored separators by means of the transport of electrolyte across the separator. It is not possible to completely separate the catholyte from the anolyte. It is therefore also not possible to completely prevent amines from reaching the anode and being oxidised there. The formation of cyanide therefore cannot be completely ruled out using this method.

A further disadvantage of this method is that if separators having a very small pore diameter (for example 10 nm) are used, the electrolyte exchange and thus the current transfer is greatly inhibited, which leads to an overvoltage. Even though according to the claim the overvoltage is supposed to be less than 5 volts, a tank voltage having an overvoltage of at most 5 volts would nevertheless be almost doubled as compared to a method that works without separating the cathode and anode regions. This results in a significantly higher energy consumption during the deposition of the zinc-nickel layers. The tank voltage that is up to 5 volts higher furthermore causes the electrolyte to be greatly heated. Since the temperature of the electrolyte should be kept constant in the range of +/−2° C. in order to deposit a constant alloy composition, the electrolyte must be cooled if a higher tank voltage is applied, which requires a considerable amount of effort. Although it is described that the separator can also have a pore diameter of 50 μm, which possibly inhibits the formation of overvoltage, the relatively large pore diameter in turn, however, allows an almost unimpeded electrolyte exchange between the cathode region and the anode region and thus cannot prevent the formation of cyanides.

A similar concept is described in EP 1 717 353 B1. The anode region and the cathode region are separated herein by a filtration membrane. The size of the pores of the filtration membrane is in the range of 0.1 to 300 nm. A certain transfer of electrolyte from the cathode region to the anode region is thereby knowingly accepted.

If certain organic brighteners are used, zinc-nickel electrolytes do not function satisfactorily if membrane methods as according to EP 1 344 850 or EP 1 292 724 are employed. These brighteners obviously require anodic activation in order to produce their full effect. This reaction is ensured if filtration membranes such as described in EP 1 717 353 are used. However, this also means that the formation of cyanides cannot be completely prevented. It is apparent from Table 4 of EP 1 717 353 that if the filtration membranes are used at a bath load of 50 Ah/l, a new formation of 63 mg/l of cyanide occurs. If filtration membranes are not used, a new formation of 647 mg/l of cyanide occurs under otherwise identical conditions. The use of filtration membranes can thus reduce the new formation of cyanide by approximately 90%, but cannot prevent it completely.

All of the aforementioned membrane methods furthermore have the disadvantage that they require a considerable amount of space in a bath container of a zinc-nickel electrolyte. Retrofitting in an existing system is therefore not usually possible due to a lack of space.

Furthermore, a cell for the anodic oxidation of cyanides in aqueous solutions, comprising a fixed-bed anode as well as a cathode, is described in DE 103 45 594 A1, which is characterised in that the particle bed of the anode is formed of particles of manganese or the oxides of titanium or mixtures of these particles. It is described in the laid-open document that this method is suitable for reducing cyanometallate complexes in waste waters. The aim when treating the cyanide-containing aqueous solutions as described in DE 103 45 594 A1 is thus to remove already existing cyanides and cyanometallate complexes from the waste water. This is in contrast to the object of the present invention, in which the formation of cyanides is supposed to be prevented in the first place.

OBJECT

The object of the present invention is to provide a method for the galvanic deposition of zinc and zinc alloy coatings from an alkaline coating bath comprising zinc and zinc alloy electrolytes and organic bath additives, which leads to a reduced anodic oxidation and a consequent reduced degradation of the organic bath additives, such as complexing agents, brighteners, wetting agents, etc., as well as to a reduced formation of undesirable degradation products such as cyanides. The method according to the invention is supposed to enable integration in existing alkaline zinc and zinc alloy baths without additional effort and to allow a significantly more economical operation of the method.

SOLUTION OF THE OBJECT AND DETAILED DESCRIPTION

Figure 1:
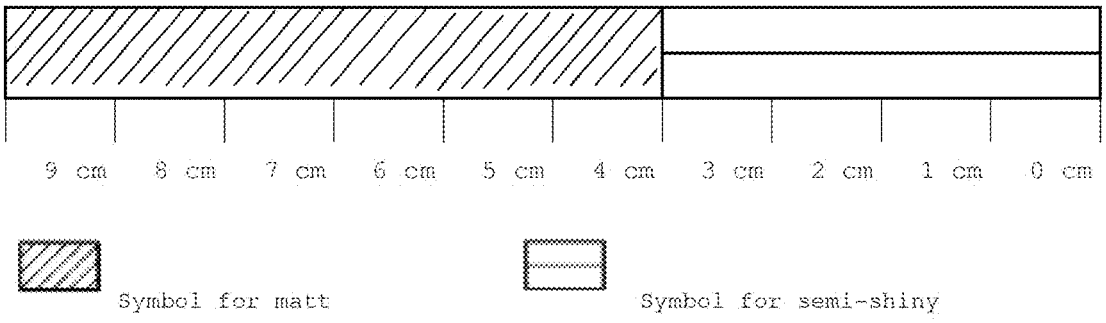
FIG. 1 shows the result of the test sheets that were coated in a bath operated with comparative anodes 1 to 3.

The object as defined above is solved by the provision of a method for the galvanic deposition of zinc and zinc alloy coatings from an alkaline coating bath comprising zinc and zinc alloy electrolytes and organic bath additives, in which an electrode that is insoluble in the bath and contains metallic manganese and/or manganese oxide is used as the anode, which 1) is produced from metallic manganese or a manganese-containing alloy, the manganese-containing alloy comprising at least 5% by weight of manganese, or
2) is produced from an electrically conductive substrate and a metallic manganese and/or manganese oxide-containing coating applied thereto, the metallic manganese and/or manganese oxide-containing coating comprising at least 5% by weight of manganese, based on the total amount of manganese resulting from metallic manganese and manganese oxide, or
3) is produced from a composite material comprising metallic manganese and/or manganese oxide and an electrically conductive material, the composite material comprising at least 5% by weight of manganese, based on the total amount resulting from metallic manganese and manganese oxide.

It has been surprisingly found that the use of insoluble, metallic manganese and/or manganese oxide-containing electrodes, as described above, has a very positive effect on the reduction of the degradation of organic bath additives such as complexing agents, brighteners, wetting agents, etc. This is particularly advantageous in coating baths comprising amine-containing complexing agents since as a result of the lower degradation of the amine compounds, a significant reduction in the cyanide concentration also simultaneously occurs.

Spectroscopic examinations have shown that the decisive component for the reduced degradation of the organic bath additives as well as the reduced formation of cyanides is manganese oxide. However, metallic manganese can also be used since when operated as an anode in the alkaline zinc and zinc alloy electrolyte, manganese oxides, often in the form of a brown/black film, are formed in situ. The formed manganese oxides can thereby be present in various degrees of oxidation.

The aforementioned embodiments of the metallic manganese and/or manganese oxide-containing electrode will be explained in more detail in the following.

Solid Electrodes

Electrodes that are produced from metallic manganese or a manganese-containing alloy and that are suitable for use as an insoluble anode in an alkaline zinc and zinc alloy bath come into question for the method according to the invention. The manganese-containing alloy is preferably selected from a manganese-containing steel alloy or a manganese-containing nickel alloy. In the method according to the invention, the use of a manganese-containing steel alloy is particularly preferred. The alloy part of the manganese-containing alloy has a manganese content of at least 5% by weight of manganese, preferably 10 to 90% by weight of manganese, and particularly preferred 50 to 90% by weight of manganese. Commercially available steel electrodes have, for example, a manganese content of 12% by weight of manganese (X120Mn12 with material number 1.3401) or 50% by weight of manganese (spiegeleisen).

Coated Carrier Electrodes

In addition to the aforementioned solid electrodes that are produced from metallic manganese or a manganese-containing alloy, electrodes produced from an electrically conductive substrate material that is suitable for use as an insoluble anode in an alkaline zinc and zinc alloy bath, with a metallic manganese and/or manganese oxide-containing coating applied thereto, also come into question. The substrate material is preferably selected from steel, titanium, nickel or graphite. In the method according to the invention, the use of steel as the substrate material is particularly preferred. The metallic manganese and/or manganese oxide-containing coating has a manganese content of at least 5% by weight of manganese, preferably 10 to 100% by weight of manganese, particularly preferred 50 to 100% by weight of manganese, and in particular preferred 80 to 100% by weight of manganese, based on the total amount of manganese resulting from metallic manganese and manganese oxide.

It is thereby not decisive how the metallic manganese and/or manganese oxide-containing coating is applied to the surface of the substrate as long as it adheres firmly thereto. The metallic manganese and/or manganese oxide-containing coating can therefore be applied to the substrate by means of a plurality of methods, inter alia by means of thermal spraying, build-up welding or gas phase deposition, such as physical gas phase deposition (PVD from the English "physical vapour deposition"). The layer thickness of the metallic manganese and/or manganese oxide-containing coating is thereby not decisive and, depending on the method, can range from a few nanometres (for example using a PVD method) up to several millimetres (for example using a thermal spraying method).

Thermal Spraying

As has already been stated above, the metallic manganese and/or manganese oxide-containing coating can be applied to the substrate by means of thermal spraying. The manganese-containing coating material used for thermal spraying can thereby consist of both metallic manganese as well as of a mixture containing iron and/or nickel in addition to metallic manganese.

The manganese-containing coating material used for thermal spraying thereby preferably has a manganese content of 80% by weight of manganese or more, preferably 90% by weight of manganese or more, and particularly preferred 100% by weight of manganese.

The manganese-containing coating material is preferably used in a form that is suitable for thermal spraying, for example as a powder or wire.

During thermal spraying, softened, partly melted or molten spray particles that are heated inside or outside of a spray torch are normally accelerated by means of an atomising gas (for example compressed air or an inert gas such as nitrogen and argon) and propelled onto the surface of the substrate to be coated. As a result hereof, mainly owing to mechanical interlocking, a good bond to the substrate surface and a firmly adhering metallic manganese and/or manganese oxide layer is formed.

In order to achieve a particularly good adhesion of the layer to the surface of the substrate, additional measures can be carried out. For example, the substrate to be coated can be roughened prior to the thermal spraying process by means of corundum blasting (the blasting material here is zirconium corundum). A further possibility is to arrange an additional primer layer between the substrate and the metallic manganese and/or manganese oxide-containing coating. The primer layer can consist, for example, of nickel. Owing to the use of a primer layer, the adhesion of the thermally sprayed layer to the substrate is further improved. A primer layer is preferably extensively applied directly onto the substrate before the manganese-containing coating material is thermally sprayed on. The primer layer can be produced using the same thermal spraying process as the metallic manganese and/or manganese oxide-containing coating, for example by means of flame spraying or arc spraying. The primer layer is normally produced with a layer thickness of 50 to 100 μm. If a primer layer is used, the manganese-containing coating material is, as a rule, thermally sprayed directly onto the primer layer.

If a primer layer is not used, the manganese-containing coating material is, as a rule, thermally sprayed directly onto the substrate to be coated.

The manganese-containing coating material can be thermally sprayed onto the substrate by means of conventional spraying processes. These are inter alia: wire arc spraying, thermo-spray powder spraying, flame spraying, high velocity flame spraying, plasma spraying, autogenous rod spraying, autogenous wire spraying, laser spraying, cold gas spraying, detonation spraying and PTWA spraying (Plasma Transferred Wire Arc). These processes are known to the person skilled in the art per se. The manganese-containing coating material can be applied to the substrate in particular by means of flame spraying or arc spraying. Flame spraying is particularly suitable for the use of a powdery manganese-containing coating material.

In powder flame spraying, a distinction is made between self-fluxing and self-adhering powders. Self-fluxing powders normally require an additional thermal post-treatment, as a result of which the adhesion of the sprayed layer to the substrate is greatly increased. The thermal post-treatment is normally carried out using oxy-acetylene torches. The thermal post-treatment renders the sprayed layer impervious to both gas and liquid, which is why the manganese-containing coating material is preferably applied to the substrate by means of powder flame spraying.

From a technical point of view, layer thicknesses of from 50 μm up to several millimetres can be applied to the substrate using the aforementioned processes.

Furthermore, thermal spraying can be carried out both in an air atmosphere as well as in an inert gas atmosphere. This can generally be regulated by the type of atomising gas. If an inert gas such as nitrogen or argon is used as the atomising gas, oxidation of the manganese-containing coating material will be largely prevented. A manganese layer consisting of metallic manganese or a manganese alloy can, for example, be applied to the substrate in this manner. In the method according to the invention, manganese oxides would then, over the course of the galvanic deposition process, form on the carrier anode having the metallic manganese or manganese alloy layer applied thereto, which represent the active surface. These can alternatively also be applied to the substrate beforehand. This has the advantage that the active surface does not have to form during the galvanic deposition process, and thus a positive effect, i.e. suppression of the anodic oxidation of the organic bath additives, already becomes visible after just a short period of time. Owing to the use of, for example, compressed air, oxidation products form from the used manganese-containing coating material as a result of the high temperatures, which solidify with the melt on the surface of the coating and thus form a firmly adhering film. In addition to metallic manganese and possibly iron and/or nickel, the manganese-containing coating material sprayed in an air atmosphere then also contains, as the layer applied to the substrate, manganese oxides as well as possibly iron oxides and/or nickel oxides or combinations thereof.

Build-Up Welding

In addition to thermal spraying, the metallic manganese and/or manganese oxide-containing coating can also be applied by means of build-up welding, also called weld cladding. The manganese-containing coating material used for build-up welding can thereby consist of both metallic manganese as well as of a mixture containing iron and/or nickel in addition to metallic manganese.

The manganese-containing coating material thereby preferably has a manganese content of 80% by weight of manganese or more, preferably 90% by weight of manganese or more, particularly preferred 100% by weight of manganese.

The manganese-containing coating material is preferably used in a form that is suitable for build-up welding, for example as a powder, wire, bar, strip, paste or flux-cored wire.

In build-up welding, both the coating material as well as a thin surface layer of the substrate to be coated are normally melted by means of suitable energy sources and metallurgically bound together. The diffusion and mixing of the coating material with the substrate material thus leads to a firmly adhering, pore-free layer. Build-up welding essentially differs from thermal spraying in that the surface of the substrate is melted during build-up welding.

The manganese-containing coating material can be applied to the substrate by means of conventional build-up welding processes. Suitable energy sources herefor include inter alia: electric arc, flame, Joule heat, plasma beam, laser beam and electron beam. These energy sources are known to the person skilled in the art per se.

From a technical point of view, relatively high layer thicknesses of 1 mm or more can be applied to the substrate by means of the aforementioned processes. In addition, the power source is guided over the substrate in a pendulum motion, as a result of which the manganese-containing coating material is then applied in individual layers.

Furthermore, similar to thermal spraying, build-up welding can also be carried out both in an air atmosphere as well as in an inert gas atmosphere such as nitrogen or argon. In an inert gas atmosphere, for example a manganese layer of metallic manganese or a manganese alloy can be applied to the substrate. In an air atmosphere, oxidation products form from the used manganese-containing coating material as a result of the high temperatures. The layer formed in an air atmosphere then contains, in addition to metallic manganese and possibly iron and/or nickel, also manganese oxides as well as possibly iron oxides and/or nickel oxides or combinations thereof.

Gas Phase Deposition

The metallic manganese and/or manganese oxide-containing coating can furthermore also be applied to the substrate by means of gas phase deposition such as physical gas phase deposition (PVD).

The manganese-containing coating material used for physical gas phase deposition is normally metallic manganese, however other manganese-containing solid materials that are suitable for this process, such as manganese oxide, can also be used.

The manganese-containing coating material can be applied to the substrate by means of conventional gas phase deposition processes. The physical gas phase deposition processes include the following methods: evaporation, such as thermal evaporation, electron beam evaporation, laser evaporation and arc evaporation, sputtering and ion plating as well as reactive variants of these methods.

In the PVD process, the manganese-containing coating material is normally atomised (for example in the case of sputtering) or brought into the gas phase (for example in the case of evaporation) by bombardment with laser beams, magnetically deflected ions, electrons or by arc discharge such that it subsequently deposits on the surface of the substrate to be coated as a manganese-containing solid material.

So that the gaseous manganese-containing coating material also reaches the substrate to be coated, the method must be carried out at a reduced pressure of approximately $10^{-4}$-10 Pa.

From a technical point of view, layer thicknesses of 100 nm to 2 mm can be applied to the substrate by means of PVD processes.

Composite Anodes

In addition to manganese-containing solid electrodes and carrier electrodes coated with metallic manganese and/or manganese oxide, electrodes made of a composite material that comprises metallic manganese and/or manganese oxide and a conductive material also come into question. Carbon, preferably graphite, can, for example, be used as the conductive material.

The composite material containing metallic manganese and/or manganese oxide has a manganese content of at least 5% by weight of manganese, preferably at least 10% by weight of manganese, particularly preferred at least 50% by weight of manganese, based on the total amount of manganese resulting from metallic manganese and manganese oxide.

The manner in which such a manganese-containing composite electrode is produced is not specifically limited. Conventional processes, such as sintering or compaction with binding agents, are therefore suitable. The manganese-containing composite electrode can furthermore also be produced by incorporating metallic manganese or manganese oxide in foamed metal. These processes are known to the person skilled in the art per se.

Zinc and Zinc Alloy Baths

In the method according to the invention for the galvanic deposition of a zinc and zinc alloy coating from an alkaline electrolyte, the zinc and zinc alloy baths are not specifically limited provided that they are alkaline and contain organic bath additives such as complexing agents, brighteners, wetting agents, etc.

A typical zinc and zinc alloy bath for the method according to the invention is, for example, an alkaline zinc-nickel alloy bath. Such a zinc-nickel alloy bath is used for the deposition of a zinc-nickel alloy coating from an alkaline zinc-nickel electrolyte onto a substrate used as the cathode. In a new preparation, this typically contains a zinc ion concentration in the range of 5 to 15 g/l, preferably 6 to 10 g/l calculated as zinc, and a nickel ion concentration in the range of 0.5 to 3 g/l, preferably 0.6 to 1.5 g/l calculated as nickel. The zinc and nickel compounds used for the production of the zinc-nickel electrolyte are not specifically limited. Nickel sulphate, nickel chloride, nickel sulphamate or nickel methanesulphonate can, for example, be used. The use of nickel sulphate is particularly preferred.

The alkaline zinc and zinc alloy baths furthermore contain organic bath additives such as complexing agents, brighteners, wetting agents, etc.

The addition of complexing agents is unavoidable in particular when using zinc-nickel electrolytes since the nickel is not amphoteric and therefore does not dissolve in the alkaline electrolyte. Alkaline zinc-nickel electrolytes therefore contain specific complexing agents for nickel. The complexing agents are not specifically limited and any known complexing agent may be used. Amine compounds such as triethanolamine, ethylenediamine, tetrahydroxypropyl ethylenediamine (Lutron Q 75), diethylenetetramine or homologous compounds of ethylenediamine, such as diethylenetriamine, tetraethylenepentamine, etc. are preferably used. The complexing agent and/or mixtures of these complexing agents are normally used at a concentration in the range of 5 to 100 g/l, preferably 10 to 70 g/l, more preferably 15 to 60 g/l.

Furthermore, brighteners are normally additionally used in zinc and zinc alloy baths. These are not specifically limited and any known brightener may be used. Aromatic or heteroaromatic compounds, such as benzyl pyridinium carboxylate or pyridinium-N-propane-3-sulphonic acid (PPS), are preferably used as brighteners.

Furthermore, the electrolyte used in the method according to the invention is basic. In order to adjust the pH value, sodium hydroxide and/or potassium hydroxide can, as an example but not limited hereto, be used. Sodium hydroxide is particularly preferred. The pH of the aqueous alkaline solution is normally 10 or more, preferably 12 or more, particularly preferred 13 or more. A zinc-nickel bath therefore normally contains 80 to 160 g/l of sodium hydroxide. This corresponds to an approximately 2 to 4 mole solution.

Cathodes or Substrates to be Coated

The substrate used as the cathode is not specifically limited and any known materials that are suitable for use as a cathode in a galvanic coating method for the deposition of a zinc or zinc alloy coating from an alkaline electrolyte may be used. In the method according to the invention, substrates of, for example, steel, hardened steel, forge-cast material or die-cast zinc can therefore be used as the cathode.

In addition to the methods described above, the invention furthermore relates to the use 1) of metallic manganese or a manganese-containing alloy, the manganese-containing alloy containing at least 5% by weight of manganese, or
2) of an electrically conductive substrate and a metallic manganese and/or manganese oxide-containing coating applied thereto, the metallic manganese and/or manganese oxide-containing coating comprising at least 5% by weight of manganese, based on the total amount of manganese resulting from metallic manganese and manganese oxide, or
3) of a composite material comprising metallic manganese and/or manganese oxide and an electrically conductive material, the composite material comprising at least 5% by weight of manganese, based on the total amount resulting from metallic manganese and manganese oxide, as the anode for the galvanic deposition of zinc and zinc alloy coatings from an alkaline coating bath comprising zinc and zinc alloy electrolytes and organic bath additives.

A galvanic apparatus for the deposition of zinc and zinc alloy coatings from an alkaline coating bath comprising zinc and zinc alloy electrolytes and organic bath additives is furthermore provided, which contains as the anode an insoluble metallic manganese and/or manganese oxide-containing electrode such as described above.

The apparatus according to the invention does not require the anode region and the cathode region to be separated from one another by means of membranes and/or separators.

The invention will be explained in more detail in the following by means of examples.

EXAMPLES

Test Example 1.1

Load tests were carried out with the alkaline zinc-nickel electrolyte SLOTOLOY ZN 80 (of the firm Schlötter) using different anode materials. The deposition behaviour at a constant cathodic and anodic current density was thereby analysed over a long period of time. The zinc-nickel electrolyte was examined as a function of the amount of applied current with respect to the degradation products forming on the anode, such as cyanide. The organic complexing agents and brighteners were also analysed.

Test Conditions:

The basic bath preparation (2 litres of SLOTOLOY ZN 80) had the following composition:

Zn: 7.5 g/l as ZnO
Ni: 0.6 g/l as $NiSO_4 \times 6\ H_2O$
NaOH: 120 g/l
SLOTOLOY ZN 81: 40 ml/l (complexing agent mixture)
SLOTOLOY ZN 82: 75 ml/l (complexing agent mixture)
SLOTOLOY ZN 87: 2.5 ml/l (basic brightening additive)
SLOTOLOY ZN 83: 2.5 ml/l (basic brightening additive
SLOTOLOY ZN 86: 1.0 ml/l (top brightener)

The aforementioned basic bath preparation contains: 10.0 g/l of DETA (diethylenetriamine), 9.4 g/l of TEA (85% by weight of triethanolamine), 40.0 g/l of Lutron Q 75 (BASF; 75% by weight of tetrahydroxypropyl ethylenediamine) and 370 mg/l of PPS (1-(3-sulfopropyl)-pyridinium-betaine).

The bath temperature was adjusted to 35° C. The stirring speed during the current yield sheet coating was 250 to 300 rpm. The stirring speed during the load sheet coating was, in contrast, 0 rpm. The current densities at the anode as well as at the cathode were kept constant. The cathodic current density was $I_c$=2.5 A/dm$^2$ and the anodic current density was $I_a$=15 A/dm$^2$.

The following anode and cathode materials were used:

Cathode material: Cold rolled steel sheet according to DIN EN 10139/10140 (quality: DC03 LC MA RL)

Anode Materials:

Comparative Anode 1: Steel with material number 1.0330 or DC01 (composition: C 0.12%; Mn 0.6%, P 0.045%; S 0.045%); commercially available Comparative Anode 2: Bright nickel-plated steel; steel (material number 1.0330) with a coating layer of 30 μm bright nickel (coated with SLOTONIK 20 electrolyte of the firm Schlötter);

Production: See in this regard J. N. Unruh, "Tabellenbuch Galvanotechnik", 7th edition, EUGEN G. LEUZE Verlag, Bad Saulgau, page 515)

Comparative Anode 3: Steel (material number 1.0330) with an iron oxide layer applied thereon by means of thermal spraying (hereinafter defined as "Fe oxide anode"); Production: A 2 mm thick steel sheet (material number 1.0330) was degreased, blasted with glass beads (diameter 150 to 250 μm) and subsequently rid of any adhering residues by means of compressed air. The steel sheet was then first of all thermally sprayed with nickel by means of arc spraying in order to improve the primer layer. A nickel wire was thereby melted in the electric arc (temperature at the torch head 3000 to 4000° C.) and sprayed onto the steel sheet at a distance of 15 to 18 cm using compressed air (6 bar) as the atomising gas. The iron oxide layer was subsequently also applied by arc spraying. An iron wire (so-called iron arc wire comprising 0.7% by weight Mn, 0.07% by weight C and for the rest Fe; diameter 1.6 mm) was thereby melted in the electric arc (temperature at the torch head 3000 to 4000° C.) and sprayed onto the steel sheet at a distance of 15 to 18 cm using compressed air (6 bar) as the atomising gas. Coating was carried out by means of a swinging motion until an even, approximately 300 μm thick, thermally sprayed iron oxide layer had been produced.

Anode 1 According to the Invention: Steel (material number 1.0330) with a manganese oxide layer applied thereon by means of thermal spraying (hereinafter defined as "Mn oxide anode");

Production: A 2 mm thick steel sheet (material number 1.0330) was degreased, roughened by means of corundum blasting (the blasting material here is zirconium corundum) and subsequently rid of any adhering residues by means of compressed air. The steel sheet was then first of all thermally sprayed with nickel by means of arc spraying in order to improve the primer layer. A nickel wire was thereby melted in the electric arc (temperature at the torch head 3000 to 4000° C.) and sprayed onto the steel sheet at a distance of 15 to 18 cm using compressed air (6 bar) as the atomising gas. The manganese oxide layer was subsequently thermally sprayed thereon by means of powder flame spraying. Metallic manganese powder (−325 mesh, ≥0.99% by Sigma Aldrich) was thereby melted in an oxy-acetylene flame (temperature of the torch flame was 3160° C.) and sprayed onto the steel sheet at a distance of 15 to 20 cm using compressed air (max 3 bar) as the atomising gas. Coating was carried out by means of a swinging motion until an even, approximately 250 μm thick, thermally sprayed manganese oxide layer had been produced.

After applying a current amount of in each case 5 Ah/l, the brighteners or fine-grain additives specified below were added to the zinc-nickel electrolyte:

SLOTOLOY ZN 86: 1 ml (corresponds to an addition rate of 1 1/10 kAh)

SLOTOLOY ZN 83: 0.3 ml (corresponds to an addition rate of 0.3 1/10 kAh)

After applying a current amount of in each case 2.5 Ah/l, the amount of deposited zinc-nickel alloy present on the deposition sheet (cathode) was determined based on the end weight. The total amount of metal missing in the zinc-nickel electrolyte owing to deposition was converted to 85% by weight zinc and 15% by weight nickel (for example for a deposited total metal amount of 1.0 g zinc-nickel alloy layer, 850 mg of zinc and 150 mg of nickel were added).

The zinc consumed in the electrolyte was added as zinc oxide and the consumed nickel was replenished by the nickel-containing liquid concentrate SLOTOLOY ZN 85. SLOTOLOY ZN 85 contains nickel sulphate as well as the amines triethanolamine, diethylenetriamine and Lutron Q 75 (1 ml of SLOTOLOY ZN 85 contains 63 mg of nickel).

The NaOH content was determined by means of acid-base titration after in each case 10 Ah/l and respectively adjusted to 120 g/l.

Experimental Procedure and Results:

After applying a current amount of 50 Ah/l and 100 Ah/l, the amount of formed cyanide was determined in each case. The results of the analytical determination are shown in Table 2 as a function of the bath load.

TABLE 2

| Anode | Anode material | Cyanide content (mg/l) after 50 Ah/l load | Cyanide content (mg/l) after 100 Ah/l load |
|---|---|---|---|
| Comparative anode 1 | Steel anode | 116 | 224 |
| Comparative anode 2 | Bright nickel-plated steel anode | 130 | 234 |
| Comparative anode 3 | Fe oxide anode | 195 | 288 |
| Anode 1 according to the invention | Mn oxide anode | 75 | 106 |

Determination of the cyanide took place by means of the cuvette test LCK 319 for easily liberatable cyanide of the firm Dr. Lange (nowadays the firm Hach). Easily liberatable cyanides are thereby converted into gaseous HCN by means of a reaction and pass through a membrane into an inductor cuvette. The colour change of the indicator is then photometrically evaluated.

As is shown in Table 2, the lowest amount of cyanide was formed when using the Mn oxide anode according to the invention. Even after applying a current amount of 100 Ah/l, the cyanide content when using the Mn oxide anode as according to the invention was only half as much as when compared to comparative anodes 1 to 3.

The amount of still present complexing agents was also determined after applying a current amount of in each case 50 Ah/l and 100 Ah/l. The results of the analytical determination are summarised in Table 3 as a function of the bath load.

TABLE 3

| | | After 50 Ah/l load | | | After 100 Ah/l load | | |
|---|---|---|---|---|---|---|---|
| Anode | Anode material | DETA (g/l) | TEA (85% by weight) (g/l) | Lutron Q 75 (g/l) | DETA (g/l) | TEA (85% by weight) (g/l) | Lutron Q 75 (g/l) |
| Comparative anode 1 | Steel anode | 7.8 | 9.0 | 41.0 | 7.3 | 9.8 | 45.3 |
| Comparative anode 2 | Bright nickel-plated steel anode | 8.0 | 9.1 | 42.1 | 7.0 | 9.4 | 46.9 |
| Comparative anode 3 | Fe oxide anode | 7.8 | 8.8 | 41.6 | 6.8 | 8.0 | 43.7 |
| Anode 1 according to the invention | Mn oxide anode | 10.2 | 9.9 | 41.1 | 10.2 | 10.8 | 43.2 |

As is shown in Table 3, considerably fewer amines (DETA and TEA) were consumed when using the Mn oxide anode according to the invention. Even after applying a current amount of 100 Ah/l, the consumption of DETA and TEA was considerably lower when using the Mn oxide anode according to the invention as compared to comparative anodes 1 to 3.

Test Example 1.2

Test Conditions:

Test example 1.2 was carried out under the same conditions as described for test example 1.1.

Experimental Procedure and Results:

A cold rolled flat steel sheet (DIN EN 10139/10140; quality: DC03 LC MA RL) having a sheet surface of 1 $dm^2$ was used in each case as the cathode and was coated with a zinc-nickel electrolyte using the comparative anodes 1 to 3 as well as the Mn oxide anode according to the invention. The current yield as well as the nickel alloy proportion were thereby determined in the original state and after applying a current amount of 100 Ah/l at cathodic current densities of 0.25, 2.5 and 4 $A/dm^2$.

The result of the determination of current yield and nickel alloy proportion is shown in Tables 4 to 7 as a function of bath load.

TABLE 4

| Comparative Anode 1//Steel Anode | | | | | | |
|---|---|---|---|---|---|---|
| | 0.25 $A/dm^2$ | | 2.5 $A/dm^2$ | | 4.0 $A/dm^2$ | |
| Load | Ni [%] | CY [%] | Ni [%] | CY [%] | Ni [%] | CY [%] |
| 0 Ah/l | 12.2 | 87.2 | 15.4 | 33.7 | 15.6 | 26.7 |
| 100 Ah/l | 12.8 | 61.9 | 14.0 | 33.8 | 14.6 | 27.2 |

TABLE 5

| Comparative Anode 2//Bright Nickel-Plated Steel Anode | | | | | | |
|---|---|---|---|---|---|---|
| | 0.25 $A/dm^2$ | | 2.5 $A/dm^2$ | | 4.0 $A/dm^2$ | |
| Load | Ni [%] | CY [%] | Ni [%] | CY [%] | Ni [%] | CY [%] |
| 0 Ah/l | 11.8 | 84.0 | 15.3 | 32.6 | 15.6 | 26.1 |
| 100 Ah/l | 12.8 | 55.7 | 14.4 | 32.6 | 14.3 | 25.5 |

TABLE 6

| Comparative Anode 3//Fe Oxide Anode | | | | | | |
|---|---|---|---|---|---|---|
| | 0.25 $A/dm^2$ | | 2.5 $A/dm^2$ | | 4.0 $A/dm^2$ | |
| Load | Ni [%] | CY [%] | Ni [%] | CY [%] | Ni [%] | CY [%] |
| 0 Ah/l | 12.1 | 89.3 | 15.4 | 34.1 | 15.3 | 26.8 |
| 100 Ah/l | 11.8 | 69.2 | 14.0 | 40.5 | 14.3 | 31.1 |

TABLE 7

| Anode 1 According to the Invention//Mn Oxide Anode | | | | | | |
|---|---|---|---|---|---|---|
| | 0.25 $A/dm^2$ | | 2.5 $A/dm^2$ | | 4.0 $A/dm^2$ | |
| Load | Ni [%] | CY [%] | Ni [%] | CY [%] | Ni [%] | CY [%] |
| 0 Ah/l | 11.7 | 89.7 | 15.1 | 32.4 | 15.4 | 26.5 |
| 100 Ah/l | 12.9 | 63.4 | 15.0 | 37.5 | 15.3 | 28.6 |

Table 7 shows that with approximately the same nickel alloy proportion, a 3 to 8% higher current yield can be obtained, depending on the applied cathodic current density, after a 100 Ah/l load when using the Mn oxide anode according to the invention as compared to the comparative anode 2 (bright nickel-plated steel; see Table 5) that is normally used as the standard anode.

By using the Mn Oxide anode according to the invention, the predetermined layer thickness can thus, in practice, be applied to components in a shorter period of time. This leads to a significant reduction in process costs.

Test Example 1.3

Test Conditions:

Test example 1.3 was carried out under the same conditions as described for test example 1.1.

After a 100 Ah/l load, the deposition of the zinc-nickel electrolyte was examined by means of a Hull cell test according to DIN 50957. The electrolyte temperature was adjusted to 35° C. A 250 ml Hull cell was used. Cold rolled steel according to DIN EN 10139/10140 (quality: DC03 LC MA RL) was used as the cathode sheet. The cell current was 2 A and the coating time was 15 minutes.

Figure 2:
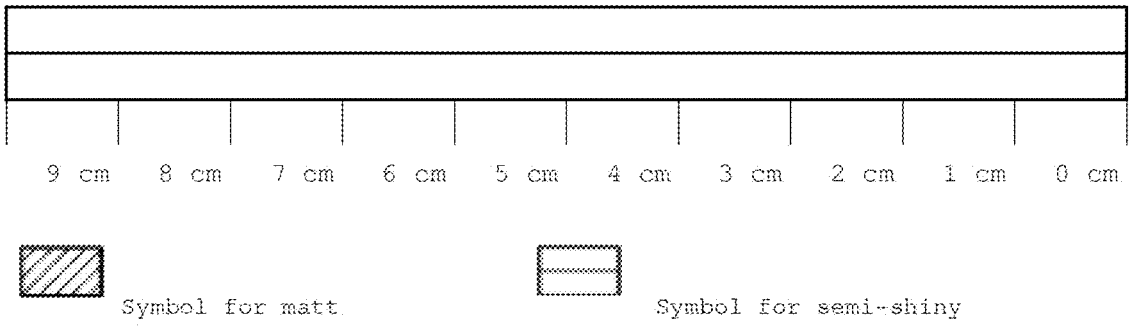
FIG. 2 shows the result of the test sheet that was coated in a bath operated with the Mn oxide anode as according to the invention.

Test Results:

The result of the Hull cell coating for determining the visual appearance and alloy distribution as a function of the bath load is shown in FIGS. 1 and 2.

FIG. 1 shows the result of the test sheets that were coated in a bath operated with comparative anodes 1 to 3. FIG. 2 shows the result of the test sheet that was coated in a bath operated with the Mn oxide anode as according to the invention.

After 100 Ah/l, the Hull cell sheet operated with the Mn oxide anode according to the invention (cf. FIG. 2) has an a uniform, semi-shiny to shiny appearance over the entire current density range, which is a measure of the still present and undestroyed bath additives.

The Hull cell sheets made of the zinc-nickel electrolytes of comparative anodes 1 to 3 only have a semi-shiny to shiny appearance in the range of <2 $A/dm^2$ (which corresponds to a distance of 4 cm from the right sheet edge to the right sheet edge). The rest of the sheet area is semi-matt to matt.

It is apparent from test examples 1.1 to 1.3 that the use of the Mn oxide anode according to the invention has a positive effect on the consumption of organic bath additives. It has been shown that the consumption of amine-containing complexing agents, in particular DETA and TEA, is significantly reduced, which leads to a reduction in the process costs. A significantly reduced formation of cyanides can also be observed. Furthermore, after 100 Ah/l, a 3 to 8% higher current yield can be obtained, depending on the current density, when using the Mn oxide anode according to the invention than can be achieved with comparative anode 2, which in turn considerably reduces process costs. In addition to the aspects cited above, a deterioration in brightness formation, as compared to the use of comparative anodes 1 to 3, does not occur when using the Mn oxide anode according to the invention even after a load of 100 Ah/l.

Test Example 2

Load tests were carried out with the alkaline zinc-nickel electrolyte SLOTOLOY ZN 210 (of the firm Schlötter) using different anode materials. The deposition behaviour at a constant cathodic and anodic current density was thereby analysed over a long period of time. The zinc-nickel electrolyte was examined as a function of the amount of applied current with respect to the degradation products forming on the anode, such as cyanide. The organic complexing agents and brighteners were also analysed.

Test Conditions:

The basic bath preparation (2 litres of SLOTOLOY ZN 210) had the following composition:

Zn: 7.5 g/l as ZnO

Ni: 1.0 g/l as $NiSO_4 \times 6\ H_2O$

NaOH: 120 g/l

SLOTOLOY ZN 211: 100 ml/l (complexing agent mixture)

SLOTOLOY ZN 212: 30 ml/l (complexing agent mixture)

SLOTOLOY ZN 215: 14 ml/l (nickel solution)

SLOTOLOY ZN 213: 5 ml/l (basic brightening additive)

SLOTOLOY ZN 216: 0.2 ml/l (top brightener)

The aforementioned basic bath preparation contains: 22.4 g/l of TEPA (tetraethylenepentamine), 10.2 g/l of TEA (85% by weight) and 5.4 g/l of Lutron Q 75 (BASF; 75% by weight of tetrahydroxypropyl ethylenediamine) and 75 mg/l of PPS (1-(3-sulfopropyl)-pyridinium-betaine).

The bath temperature was adjusted to 28° C. The stirring speed during the load sheet coating was 0 rpm. The current densities at the anode as well as at the cathode were kept constant. The cathodic current density was $I_c$=2.0 A/dm$^2$ and the anodic current density was $I_a$=12.5 A/dm$^2$.

The following anode and cathode materials were used:

Cathode material: Cold rolled steel sheet according to DIN EN 10139/10140 (quality: DC03 LC MA RL)

Anode Materials:

Comparative Anode 2: Bright nickel-plated steel; steel (material number 1.0330) with a coating layer of 30 μm bright nickel (coated with SLOTONIK 20 electrolyte of the firm Schlötter);

Production: See in this regard J. N. Unruh, "Tabellenbuch Galvanotechnik", 7th edition, EUGEN G. LEUZE Verlag, Bad Saulgau, page 515)

Anode 2 According to the Invention: Steel with material number 1.3401 or X120Mn12 (composition: C 1.2%; Mn 12.5%; Si 0.4%; P 0.1%; S 0.04%); commercially available (hereinafter defined as "manganese alloy anode").

After applying a current amount of in each case 2.5 Ah/l, the brighteners or fine-grain additives specified below were added to the zinc-nickel electrolyte:

SLOTOLOY ZN 214: 0.25 ml (corresponds to an addition rate of 1 1/10 kAh)

SLOTOLOY ZN 216: 0.1 ml (corresponds to an addition rate of 0.4 1/10 kAh)

After applying a current amount of in each case 2.5 Ah/l, the amount of deposited zinc-nickel alloy present on the deposition sheet (cathode) was determined based on the end weight. The total amount of metal missing in the zinc-nickel electrolyte owing to deposition was converted to 85% by weight zinc and 15% by weight nickel (for example for a deposited total metal amount of 1.0 g zinc-nickel alloy layer, 850 mg of zinc and 150 mg of nickel were added).

The nickel consumed in the electrolyte was replenished by the nickel-containing liquid concentrate SLOTOLOY ZN 215. SLOTOLOY ZN 215 contains nickel sulphate as well as the amines triethanolamine, tetraethylenepentamine and Lutron Q 75 (1 ml of SLOTOLOY ZN 215 contains 70 mg of nickel).

The NaOH content was determined by means of acid-base titration after in each case 10 Ah/l and respectively adjusted to 120 g/l.

In order to keep the zinc content in the zinc-nickel electrolyte as constant as possible during the entire coating period, zinc pellets were accordingly introduced into the electrolyte without current. Dissolution of the zinc hereby occurs owing to the alkalinity of the electrolyte. The zinc content was hereby also regularly analytically analysed by means of titration in a laboratory.

Experimental Procedure and Results:

After applying a current amount of 50 Ah/l, the amount of formed cyanide was determined.

The results of the analytical determination are shown in Table 8 as a function of the bath load.

TABLE 8

| Anode | Anode material | Cyanide content (mg/l) after 50 Ah/l load |
|---|---|---|
| Comparative anode 2 | Bright nickel-plated steel anode | 98 |
| Anode 2 according to the invention | Manganese alloy anode | 37 |

Determination of the cyanide took place by means of the cuvette test LCK 319 for easily liberatable cyanide of the firm Dr. Lange (nowadays the firm Hach). Easily liberatable cyanides are thereby converted into gaseous HCN by means of a reaction and pass through a membrane into an inductor cuvette. The colour change of the indicator is then photometrically evaluated.

As is shown in Table 8, a significantly lower amount of cyanide was formed when using the manganese alloy anode according to the invention than was formed when using comparative anode 2 (bright nickel-plated steel).

Furthermore, after applying a current amount of 50 Ah/l, the amount of additives still present was determined. The results of the analytical determination of the organic bath additives, i.e. amine-containing complexing agents, such as TEPA and TEA, as well as brighteners, such as PPS, are shown in Table 9 as a function of the bath load.

TABLE 9

| | | After 50 Ah/l load | | | |
|---|---|---|---|---|---|
| Anode | Anode material | TEPA (g/l) | TEA (85% by weight) (g/l) | Lutron Q 75 (g/l) | PPS (mg/l) |
| Comparative anode 2 | Bright nickel-plated steel anode | 25.8 | 13.6 | 6.1 | 111 |
| Anode 2 according to the invention | Manganese alloy anode | 29.6 | 15.6 | 6.2 | 148 |

As is shown in Table 9, considerably fewer amines (DETA and TEA) as well as less PPS were consumed when using the manganese alloy anode according to the invention than when using comparative anode 2. These substances were consequently oxidised to a lesser extent at the manganese alloy anode according to the invention.

Test Example 3

The manganese alloy anode according to the invention was also compared in a technical centre with the comparative anode 2 that is made of bright nickel-plated steel. For this purpose, a newly prepared SLOTOLOY ZN 80 electrolyte (of the firm Schlötter) was operated for approximately 6 months with four standard anodes made of bright nickel-plated steel (comparative anode 2) and a cyanide content of 372 mg/l was thereby achieved in the zinc-nickel electrolyte. After 6 months, the standard anodes made of bright nickel-plated steel were replaced by manganese alloy anodes according to the invention. The zinc-nickel electrolyte was then operated for a further 4 months under the same conditions.

Test Conditions:

The basic bath preparation (200 litres of SLOTOLOY ZN 80) had the following composition:

Zn: 7.5 g/l as ZnO

Ni: 0.6 g/l as $NiSO_4 \times 6\ H_2O$

NaOH: 110 g/l

SLOTOLOY ZN 81: 40 ml/l (complexing agent mixture)

SLOTOLOY ZN 82: 75 ml/l (complexing agent mixture)

SLOTOLOY ZN 87: 2.5 ml/l (basic brightening additive)

SLOTOLOY ZN 83: 2.5 ml/l (basic brightening additive)

SLOTOLOY ZN 86: 1.0 ml/l (top brightener)

The aforementioned basic bath preparation contains: 10.0 g/l of DETA (diethylenetriamine), 9.4 g/l of TEA (85% by weight of triethanolamine), 40.0 g/l of Lutron Q 75 (BASF; 75% by weight of tetrahydroxypropyl ethylenediamine) and 370 mg/l of PPS (1-(3-sulfopropyl)-pyridinium-betaine).

The bath volume was 200 litres. The bath temperature was adjusted to 33° C. The current densities at the anode as well as at the cathode were kept constant. The cathodic current density was $I_c$=2.5 A/dm$^2$ and the anodic current density was $I_a$=25 A/dm$^2$. The monthly bath load was 25000 Ah.

The following anode and cathode materials were used:

Cathode material: Cold rolled steel sheet according to DIN EN 10139/10140 (quality: DC03 LC MA RL)

Anode Materials:

Comparative anode 2: Bright nickel-plated steel; steel (material number 1.0330) with a coating layer of 30 μm bright nickel (coated with SLOTONIK 20 electrolyte of the firm Schlötter);

Production: See in this regard J. N. Unruh, "Tabellenbuch Galvanotechnik", 7th edition, EUGEN G. LEUZE Verlag, Bad Saulgau, page 515)

Anode 2 according to the invention: Steel with material number 1.3401 or X120Mn12 (composition: C 1.2%; Mn 12.5%; Si 0.4%; P 0.1%; S 0.04%); commercially available (hereinafter defined as "manganese alloy anode").

The load in the technical centre occurred under real-life conditions, i.e. the bath additives, metals and sodium hydroxide solution were continuously replenished.

After applying a current amount of in each case 5 Ah/l, the following amounts of brighteners and fine-grain additives were added to the zinc-nickel electrolyte:

During operation with bright nickel-plated steel anodes (comparative anode 2):

SLOTOLOY ZN 86: 100 ml (corresponds to an addition rate of 1 1/10 kAh)

SLOTOLOY ZN 83: 60 ml (corresponds to an addition rate of 0.6 l/10 kAh)

During operation with manganese alloy anodes as according to the invention (anode 2 according to the invention):

SLOTOLOY ZN 86: 60 ml (corresponds to an addition rate of 0.6 l/10 kAh)

SLOTOLOY ZN 83: 60 ml (corresponds to an addition rate of 0.6 l/10 kAh)

The amount of added substance SLOTOLOY ZN 86 was intentionally reduced here since the degradation of the added substance at the manganese alloy anodes according to the invention is lower.

The nickel consumed in the electrolyte was replenished by the nickel-containing liquid concentrate SLOTOLOY ZN 85. SLOTOLOY ZN 85 contains nickel sulphate as well as the amines triethanolamine, diethylenetriamine and Lutron Q 75 (1 ml of SLOTOLOY ZN 85 contains 63 mg of nickel). The necessary amount of nickel was hereby determined by means of suitable analysis methods (for example ICP, AAS).

In order to keep the zinc content in the zinc-nickel electrolyte as constant as possible during the entire coating period, zinc pellets were accordingly introduced into the electrolyte without current. Dissolution of the zinc hereby occurs owing to the alkalinity of the electrolyte. The zinc content was hereby also regularly analytically analysed by means of titration in a laboratory.

In order to keep the sodium hydroxide content in the electrolyte as constant as possible during the entire coating period, the sodium hydroxide content was hereby regularly (after each 5 Ah/l load) analytically analysed in the laboratory by means of titration and supplemented accordingly.

Excess carbonate was furthermore removed. It is known to the person skilled in the art that during prolonged operation of the electrolyte, the carbonate content in the bath increases. In order to be able to keep this at a constant value of less than 60 g/l of sodium carbonate, the carbonate was separated at regular intervals by means of so-called freezing devices. Under real-life conditions, a certain dilution of the electrolyte occurs owing to drag-out losses and the necessary freezing-out of carbonate.

Experimental Procedure and Results:

The newly prepared SLOTOLOY ZN 80 electrolyte, which was operated with four standard anodes made of bright nickel-plated steel (comparative anode 2) had a cyanide content of 372 mg/l after approximately 6 months. After this period, the standard anodes made of bright nickel-plated steel were replaced by manganese alloy anodes according to the invention (defined as "start" in Table 10). The zinc-nickel electrolyte was then operated for a further 4 months under the same conditions. The effect of the manganese alloy anodes according to the invention on the cyanide content and the organic bath additives was examined at intervals of one month.

The results of the analytical determination of cyanide as well as of the organic bath additives are shown in Table 10 as a function of the bath load.

TABLE 10

| Date | Cyanide (mg/l) | Zinc (g/l) | Nickel (g/l) | NaOH (g/l) | DETA (g/l) | TEA (85% by weight) (g/l) | Lutron Q 75 (g/l) | SLOTOLOY ZN 86 (ml/l) | PPS (mg/l) |
|---|---|---|---|---|---|---|---|---|---|
| Start | 372 | 6.5 | 1.1 | 107 | 6.5 | 9.7 | 18.1 | 1.5 | 555 |
| After 1 month | 206 | 6.9 | 0.9 | 109 | 9.3 | 11.7 | 20.2 | 1.3 | 481 |
| After 2 months | 92 | 6.5 | 0.94 | 108 | 11 | 14.9 | 14.9 | 1.5 | 555 |
| After 3 months | 18 | 6.7 | 1.0 | 102 | 11.8 | 18.1 | 12.8 | 1.2 | 444 |
| After 4 months | 23 | 7.5 | 1.1 | 101 | 12.8 | 21.4 | 14.9 | 1.4 | 518 |

Determination of the cyanide took place by means of the cuvette test LCK 319 for easily liberatable cyanide of the firm Dr. Lange (nowadays the firm Hach). Easily liberatable cyanides are thereby converted into gaseous HCN by means of a reaction and pass through a membrane into an inductor cuvette. The colour change of the indicator is then photometrically evaluated.

It is apparent from Table 10 that the cyanide content in the electrolyte reduces considerably within the test period (4 months) when using the manganese alloy anodes according to the invention.

During operation with the manganese alloy anodes according to the invention, the degree of brightness of the deposited layer increased to the extent that the cyanide content decreased.

On the premise of obtaining a consistent level of brightness of the deposited galvanic layer over the entire course of the test, the addition of the fine grain and brightener additives, such as PPS, could therefore be significantly reduced since less fine grain and brightener additive was consumed. The addition of SLOTOLOY ZN 86, which contains PPS, could therefore be reduced from an added amount of 100 ml during operation with comparative anode 2 to 60 ml owing to the use of the manganese alloy anodes according to the invention.

It is furthermore apparent that when using the manganese alloy anodes according to the invention, less of the amines DETA and TEA was consumed than was the case when using comparative anode 2.

These are two arguments that are in favour of a reduced additive degradation owing to the use of the manganese alloy anode according to the invention. A not insignificant cost advantage as regards the process costs can thus be realised owing to the reduced consumption of organic components.

Test Example 4

Load tests were carried out with the alkaline zinc-nickel electrolyte SLOTOLOY ZN 80 (of the firm Schlötter) using different anode materials. The deposition behaviour at a constant cathodic and anodic current density was thereby analysed over a long period of time. The zinc-nickel electrolyte was examined as a function of the amount of applied current with respect to the degradation products forming on the anode, such as cyanide. The organic complexing agents and brighteners were also analysed.

Test Conditions:

The basic bath preparation (2 litres of SLOTOLOY ZN 80) had the following composition:

Zn: 7.5 g/l as ZnO

Ni: 0.6 g/l as $NiSO_4 \times 6\ H_2O$

NaOH: 120 g/l

SLOTOLOY ZN 81: 40 ml/l (complexing agent mixture)

SLOTOLOY ZN 82: 75 ml/l (complexing agent mixture)

SLOTOLOY ZN 87: 2.5 ml/l (basic brightening additive)

SLOTOLOY ZN 83: 2.5 ml/l (basic brightening additive)

SLOTOLOY ZN 86: 1.0 ml/l (top brightener)

The aforementioned basic bath preparation contains: 10.0 g/l of DETA (diethylenetriamine), 9.4 g/l of TEA (85% by weight of triethanolamine), 40.0 g/l of Lutron Q 75 (BASF; 75% by weight of tetrahydroxypropyl ethylenediamine) and 370 mg/l of PPS (1-(3-sulfopropyl)-pyridinium-betaine).

The bath temperature was adjusted to 35° C. The stirring speed during the current yield sheet coating was 250 to 300 rpm. The stirring speed during the load sheet coating was, in contrast, 0 rpm. The current densities at the anode as well as at the cathode were kept constant. The cathodic current density was $I_c$=2.5 A/dm$^2$ and the anodic current density was $I_a$=15 A/dm$^2$.

The following anode and cathode materials were used:

Cathode material: Cold rolled steel sheet according to DIN EN 10139/10140 (quality: DC03 LC MA RL)

Anode Materials:

Comparative Anode 2: Bright nickel-plated steel; steel (material number 1.0330) with a coating layer of 30 μm bright nickel (coated with SLOTONIK 20 electrolyte of the firm Schlötter);

Production: See in this regard J. N. Unruh, "Tabellenbuch Galvanotechnik", 7th edition, EUGEN G. LEUZE Verlag, Bad Saulgau, page 515)

Anode 3 according to the invention: Steel (material number 1.0330) with a manganese-iron oxide layer applied thereon by means of thermal spraying (hereinafter defined as "Mn—Fe oxide anode");

Production: A 2 mm thick steel sheet (material number 1.0330) was degreased, roughened by means of corundum blasting (the blasting material here is zirconium corundum) and subsequently rid of any adhering residues by means of compressed air. The steel sheet was then first of all thermally sprayed with nickel by means of arc spraying in order to improve the primer layer. A nickel wire was thereby melted in the electric arc (temperature at the torch head 3000 to 4000° C.) and sprayed onto the steel sheet at a distance of 15 to 18 cm using compressed air (6 bar) as the atomising gas. The manganese-iron oxide layer was subsequently thermally sprayed thereon by means of powder flame spraying. A mixture of 90% by weight of metallic manganese powder (−325 mesh, ≥99% by Sigma Aldrich) and 10% by weight of metallic iron powder (−325 mesh, ≥97% by Sigma Aldrich) was used as the coating material. It was thereby ensured that the two powders had been homogeneously mixed together prior to the thermal spraying process. The metallic manganese-iron mixture was then melted in an oxy-acetylene flame (temperature of the torch flame was 3160° C.) and sprayed onto the steel sheet at a distance of 15 to 20 cm by means of compressed air (max 3 bar) as the atomising gas. Coating was carried out by means of a swinging motion until an even, approximately 250 μm thick, thermally sprayed manganese-iron oxide layer had been produced.

Anode 4 according to the invention: Steel (material number 1.0330) with a manganese-nickel oxide layer applied thereon by means of thermal spraying (hereinafter defined as "Mn—Ni oxide anode");

Production: A 2 mm thick steel sheet (material number 1.0330) was degreased, roughened by means of corundum blasting (the blasting material here is zirconium corundum) and subsequently rid of any adhering residues by means of compressed air. The steel sheet was then first of all thermally sprayed with nickel by means of arc spraying in order to improve the primer layer. A nickel wire was thereby melted in the electric arc (temperature at the torch head 3000 to 4000° C.) and sprayed onto the steel sheet at a distance of 15 to 18 cm using compressed air (6 bar) as the atomising gas. The manganese-nickel oxide layer was subsequently thermally sprayed thereon by means of powder flame spraying. A mixture of 80% by weight of metallic manganese powder (−325 mesh, ≥99% by Sigma Aldrich) and 20% by weight of metallic nickel powder (−325 mesh, ≥99% by Alfa Aesar) was used as the coating material. It was thereby ensured that the two powders had been homogeneously mixed together prior to the thermal spraying process. The metallic manganese-nickel mixture was then melted in an oxy-acetylene flame (temperature of the torch flame was 3160° C.) and sprayed onto the steel sheet at a distance of 15 to 20 cm by means of compressed air (max 3 bar) as the atomising gas. Coating was carried out by means of a swinging motion until an even, approximately 250 μm thick, thermally sprayed manganese-nickel oxide layer had been produced.

After applying a current amount of in each case 5 Ah/l, the brighteners or fine-grain additives specified below were added to the zinc-nickel electrolyte:

SLOTOLOY ZN 86: 1 ml (corresponds to an addition rate of 1 l/10 kAh)

SLOTOLOY ZN 83: 0.3 ml (corresponds to an addition rate of 0.3 l/10 kAh)

After applying a current amount of in each case 2.5 Ah/l, the amount of deposited zinc-nickel alloy present on the deposition sheet (cathode) was determined based on the end weight. The total amount of metal missing in the zinc-nickel electrolyte owing to deposition was converted to 85% by weight zinc and 15% by weight nickel (for example for a deposited total metal amount of 1.0 g zinc-nickel alloy layer, 850 mg of zinc and 150 mg of nickel were added). The zinc consumed in the electrolyte was added as zinc oxide and the consumed nickel was replenished by the nickel-containing liquid concentrate SLOTOLOY ZN 85. SLOTOLOY ZN 85 contains nickel sulphate as well as the amines triethanolamine, diethylenetriamine and Lutron Q 75 (1 ml of SLOTOLOY ZN 85 contains 63 mg of nickel).

The NaOH content was determined by means of acid-base titration after in each case 10 Ah/l and respectively adjusted to 120 g/l.

Experimental Procedure and Results:

After applying a current amount of 50 Ah/l, the amount of formed cyanide was determined.

The results of the analytical determination are shown in Table 11 as a function of the bath load.

TABLE 11

| Anode | Anode material | Cyanide content (mg/l) after 50 Ah/l load |
|---|---|---|
| Comparative anode 2 | Bright nickel-plated steel anode | 130 |
| Anode 3 according to the invention | Mn—Fe oxide anode | 42 |
| Anode 4 according to the invention | Mn—Ni oxide anode | 75 |

Determination of the cyanide took place by means of the cuvette test LCK 319 for easily liberatable cyanide of the firm Dr. Lange (nowadays the firm Hach). Easily liberatable cyanides are thereby converted into gaseous HCN by means of a reaction and pass through a membrane into an inductor cuvette. The colour change of the indicator is then photometrically evaluated.

As is shown in Table 11, a significantly lower amount of cyanide was formed when using anodes 3 and 4 as according to the invention than was formed when using comparative anode 2 (bright nickel-plated steel).

Furthermore, after applying a current amount of 50 Ah/l, the amount of additives still present was determined. The results of the analytical determination of the organic bath additives, i.e. amine-containing complexing agents such as DETA and TEA as well as Lutron Q 75, are shown in Table 12 as a function of the bath load.

TABLE 12

| | | After 50 Ah/l load | | |
|---|---|---|---|---|
| Anode | Anode material | DETA (g/l) | TEA (85% by weight) (g/l) | Lutron Q 75 (g/l) |
| Comparative anode 2 | Bright nickel-plated steel anode | 8.0 | 9.1 | 42.1 |
| Anode 3 according to the invention | Mn—Fe oxide anode | 10.0 | 9.8 | 41.7 |
| Anode 4 according to the invention | Mn—Ni oxide anode | 9.8 | 9.7 | 41.5 |

As is shown in Table 12, considerably fewer amines (DETA and TEA) were consumed when using anodes 3 and 4 according to the invention than when using comparative anode 2. These substances were consequently oxidised to a lesser extent at anodes 3 and 4 as according to the invention and thus a smaller amount thereof has to be subsequently added. This leads to a not insignificant cost advantage as regards the process costs.

The invention claimed is:

1. Method for galvanically depositing a zinc-nickel coating on a substrate from an alkaline coating bath comprising zinc-nickel electrolytes and organic bath additives, the organic bath additives including amine-containing complexing agents, wherein the method comprises the steps of:

providing the substrate as a cathode, providing an electrode as an anode that is insoluble in the bath, wherein the electrode contains metallic manganese and/or manganese oxide, and galvanically depositing the zinc-nickel coating on the substrate by applying current to the electrode, wherein cyanide is produced from the amine-containing complexing agents by anodic oxidation while applying the current to the electrode such that a concentration of cyanide in the alkaline coating bath after applying a current load of 100 A h/l to the electrode does not exceed 106 mg/l, and wherein the electrode 1) is a solid electrode made of the metallic manganese or of a manganese-containing alloy which contains said metallic manganese, the manganese-containing alloy comprising at least 5% by weight of manganese, or 2) is produced from an electrically conductive substrate selected from the group consisting of steel, nickel and carbon, and, applied to the surface of the electrically-conductive substrate, a coating containing said metallic manganese and/or manganese oxide, in the following referred to as "manganese and/or manganese oxide-containing coating", said manganese and/or manganese oxide-containing coating comprising at least 5% by weight of manganese, based on the total amount of manganese resulting from the metallic manganese and the manganese oxide, or 3) is produced from a composite material comprising the metallic manganese and/or manganese oxide and an electrically conductive material, the composite material comprising at least 5% by weight of manganese, based on the total amount resulting from the metallic manganese and the manganese oxide.

2. Method according to claim 1, wherein the manganese-containing alloy is selected from a manganese-containing steel alloy or a manganese-containing nickel alloy.

3. Method according to claim 1, wherein the manganese-containing alloy comprises 10 to 90% by weight of manganese.

4. Method according to claim 3, wherein the manganese-containing alloy comprises 50 to 90% by weight of manganese.

5. Method according to claim 1, wherein the metallic manganese and/or manganese oxide-containing coating is applied to the substrate by means of the thermal spraying of metallic manganese or a mixture of metallic manganese with iron and/or nickel.

6. Method according to claim 1, wherein the metallic manganese and/or manganese oxide-containing coating is applied to the substrate by means of the build-up welding of metallic manganese or a mixture of metallic manganese with iron and/or nickel.

7. Method according to claim 1, wherein the metallic manganese and/or manganese oxide-containing coating is applied to the substrate by means of gas phase deposition.

8. Method according to claim 1, wherein the metallic manganese and/or manganese oxide-containing coating comprises 10 to 100% by weight of manganese, based on the total amount of manganese resulting from the metallic manganese and manganese oxide.

9. Method according to claim 8, wherein the metallic manganese and/or manganese oxide-containing coating comprises 50 to 100% by weight of manganese.

10. Method according to claim 9, wherein the metallic manganese and/or manganese oxide-containing coating comprises 80 to 100% by weight of manganese.

11. Method according to claim 1, wherein the electrically conductive material of the composite material is carbon.

12. Method according to claim 11, wherein the electrically conductive material of the composite material is graphite.

13. Method according to claim 1, wherein the composite material contains at least 10% by weight of manganese.

14. Method according to claim 13, wherein the composite material contains at least 50% by weight of manganese.

* * * * *